US007072247B2

(12) United States Patent
Hiranuma et al.

(10) Patent No.: US 7,072,247 B2
(45) Date of Patent: Jul. 4, 2006

(54) WRIST WATCH

(75) Inventors: Haruki Hiranuma, Chiba (JP); Koremoto Takeda, Chiba (JP)

(73) Assignee: Seiko Instruments Inc., Chiba (JP)

( * ) Notice: Subject to any disclaimer, the term of this patent is extended or adjusted under 35 U.S.C. 154(b) by 640 days.

(21) Appl. No.: 09/919,414

(22) Filed: Jul. 31, 2001

(65) Prior Publication Data

US 2002/0021624 A1 Feb. 21, 2002

(51) Int. Cl.
*G04B 37/00* (2006.01)
*G04B 39/00* (2006.01)
*A44C 5/00* (2006.01)

(52) U.S. Cl. ..... 368/88; 368/281; 368/294; 368/300

(58) Field of Classification Search ..... 368/88, 368/276, 281, 284, 294, 295, 297–300, 309–310
See application file for complete search history.

(56) References Cited

U.S. PATENT DOCUMENTS 1,644,802 A * 10/1927 Vermot
1,727,531 A * 9/1929 Wilsdorf
2,327,112 A * 8/1943 Kramer et al.
3,386,239 A * 6/1968 Shiffman
3,505,808 A * 4/1970 Eschle ..... 368/10
3,583,151 A * 6/1971 Tissot
4,420,264 A * 12/1983 Murata ..... 368/223
4,796,240 A * 1/1989 Stevens ..... 368/281
4,975,893 A * 12/1990 Dal Busco ..... 368/294
5,122,997 A * 6/1992 Schneider et al. ..... 368/294
5,490,123 A * 2/1996 Biver ..... 368/295
5,654,941 A * 8/1997 Joss ..... 368/295
5,822,279 A * 10/1998 Cuche et al. ..... 368/295

FOREIGN PATENT DOCUMENTS

JP 50048675 8/1973
JP 2599256 12/1994
JP 07311286 11/1995
JP 10282260 10/1998

* cited by examiner

*Primary Examiner*—Vit W. Miska
(74) *Attorney, Agent, or Firm*—Adams & Wilks

(57) ABSTRACT

To provide a wrist watch capable of easily exchanging a bezel by a user per se. A wrist watch is locked in a state in which a case body packing is arranged between a main body of an inner case bodyl including a module including an electronic circuit realizing watch function and an outer case body, an upper end face of a peripheral edge of an inner face body main body is pressed by an inner wall face of a decorative bezel main body and a spring projected portion is fitted to a click hole.

4 Claims, 13 Drawing Sheets

CROSS SECTIONAL VIEW

CROSS SECTIONAL VIEW

FIG. 3C SIDE VIEW

FIG. 7A
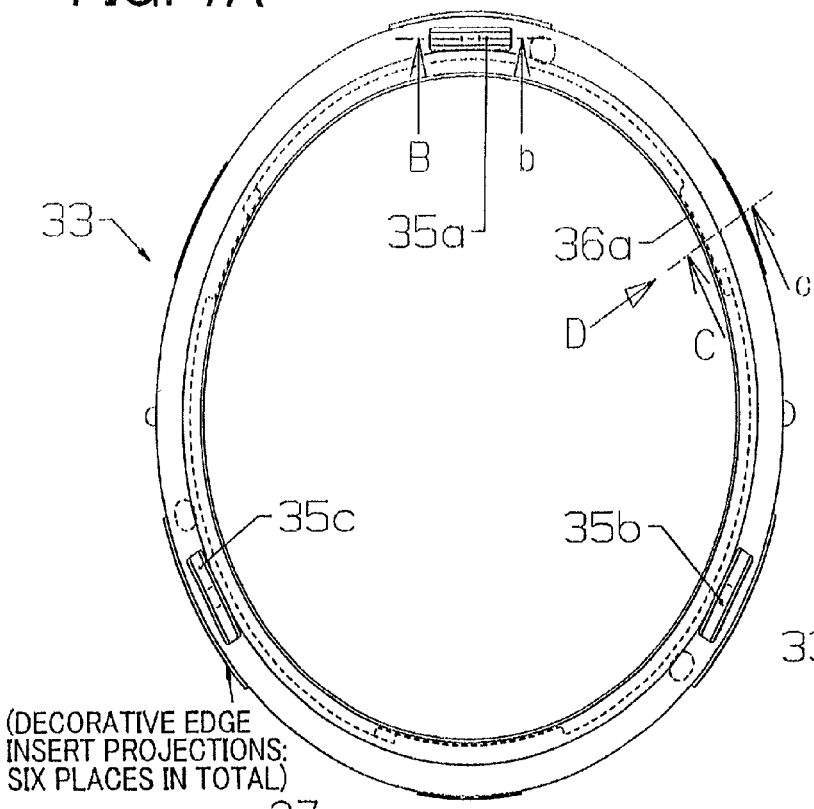
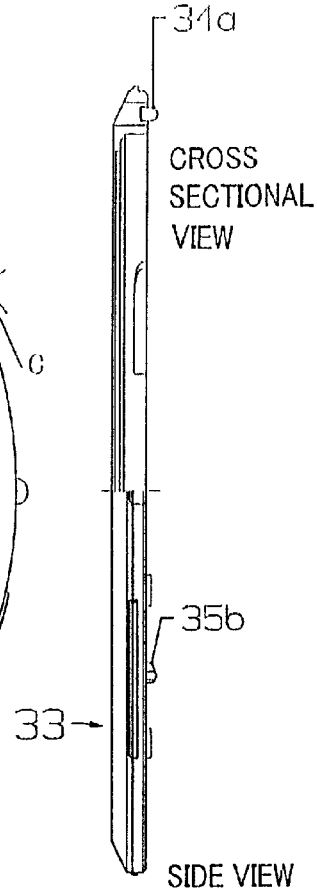
FIG. 7C
FIG. 7B
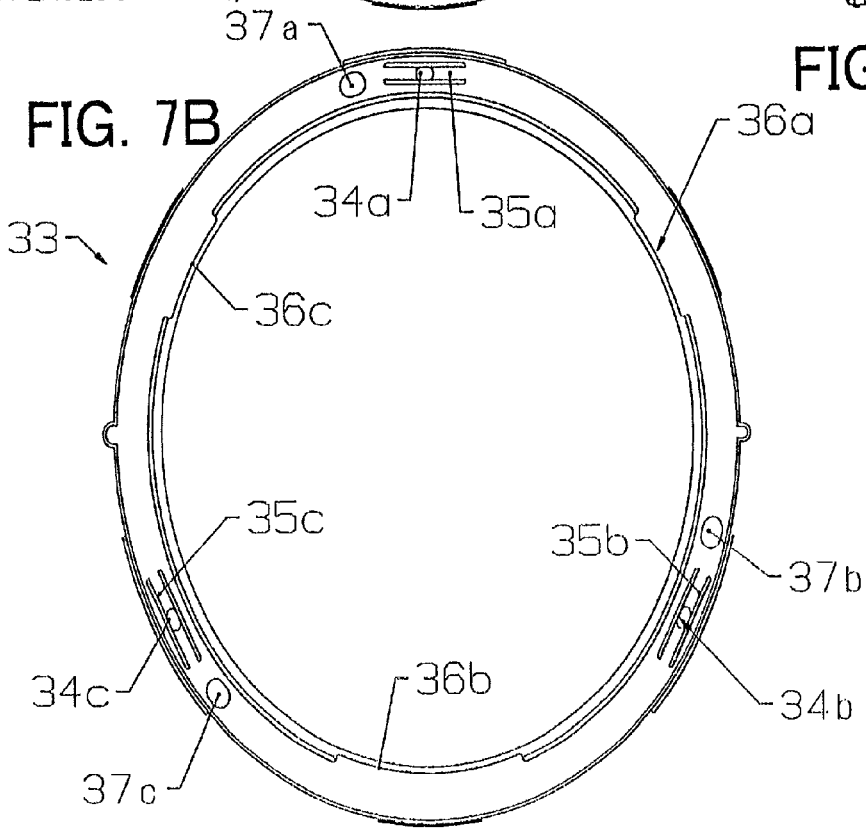

VIEW IN DIRECTION D
(BAYONET PORTION SHAPE DIAGRAM)

VIEW OF CROSS SECTION TAKEN ALONG LINE C-C
(BAYONET PORTION CROSS SECTIONAL VIEW)

WRIST WATCH

BACKGROUND OF THE INVENTION

1. Field of the Invention

The present invention relates generally to a bezel attaching structure of a wrist watch and an assembled structure of a wrist watch and, more particularly, to a wrist watch having high design performance by making a bezel easily exchangeable by a user.

2. Description of the Prior Art

Generally, there is known a wrist watch having a design in which a decorative bezel is attached at a region surrounding a glass for protecting a dial. The bezel is formed in a doughnut shape in conformity with an outer shape of a wrist watch and is attached to a surface of the wrist watch. Further, the bezel serves also as a lid of a case main body containing a watch mechanism. In that case, a glass member is adhered or welded to a hole portion of the bezel in the doughnut shape, the bezel is attached to press against the case main body of the wrist watch to thereby hermetically close the case by interposing a packing therebetween, and the bezel cannot be removed without a special tool or special technology/technique [is used]. Meanwhile, a bezel attached by a so-to-speak rotational bezel structure, is rotatably attached to the case main body and the bezel is attached thereto such that the bezel is not removed unless a special tool or special technology/technique is used.

However, according to the above-described conventional wrist watch, the bezel cannot be removed unless special tool or special technology/technique is used and accordingly, the bezel cannot be exchanged easily and there poses a problem that a restriction in view of design is imposed in providing a wrist watch attached with a bezel to suit to taste of a user.

SUMMARY OF THE INVENTION

Hence, the invention has been carried out in view of the above-described shortcoming and it is an object thereof to provide a wrist watch with an increased degree of freedom of design to suit the taste of a user and which is capable of exchanging the bezel easily by a user without the need for a special tool or special technology/technique.

In order to achieve the above-described object, the invention is characterized in that a screw mount structure including a bayonet structure is provided to attach a bezel to a wrist watch main body and comprises a projected portion or a plurality of first projections having a front end in a semi-spherical shape provided on one of the bezel and about a circumference of an opposed (or upper) face of the main body and urged to the other of the bezel and the opposed face by an elastic member, and a recess portion or a plurality of second projections provided on the other of the bezel (about an inner circumference thereof) and the opposed face and fitted to the front end of the projected portion or the first projections. Further, the bezel may be attached with a bayonet part comprising an elastic member integrally formed with the projected portion on a side of the opposed face of the main body and the main body may include the recess portion on the side of the opposed face of the bezel. Further, the recess portion may be formed by being surrounded by the projected portion projected to a face of forming thereof.

Further, the invention is characterized in a wrist watch comprising an inner case body including a watch function part, an outer case body forming a containing portion in conformity with an outer shape of the inner case body and attached with a strap made to wrap on the arm, and a bezel for fixing the inner case body to the outer case body, wherein the wrist watch is assembled by sandwiching the inner case body between the outer case body and the bezel.

BRIEF DESCRIPTION OF THE SEVERAL VIEWS OF THE DRAWINGS

A preferred form of the present invention is illustrated in the accompanying drawings in which:

FIGS. 3A–3C are explanatory views of an outer case body constituting the wrist watch according to the embodiment of the invention;

FIGS. 7A–7C are explanatory views of a bayonet part of the outer case body constituting the wrist watch according to the embodiment of the invention;

DETAILED DESCRIPTION OF THE PREFERRED EMBODIMENTS

A detailed explanation will be given of the invention in reference to the drawings as follows. Further, the invention is not limited by embodiments thereof.

Figure 1:
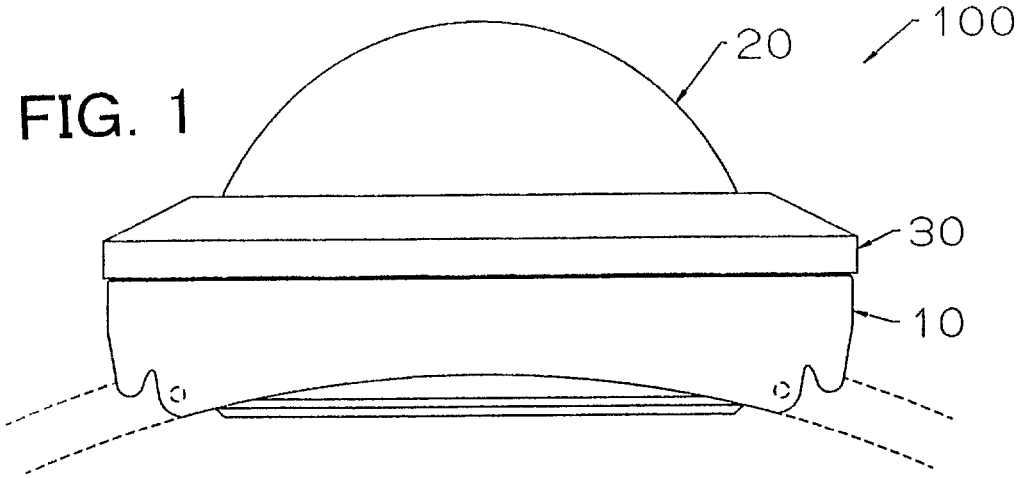
FIG. 1 is a side view of a wrist watch according to an embodiment of the invention.
Figure 2:
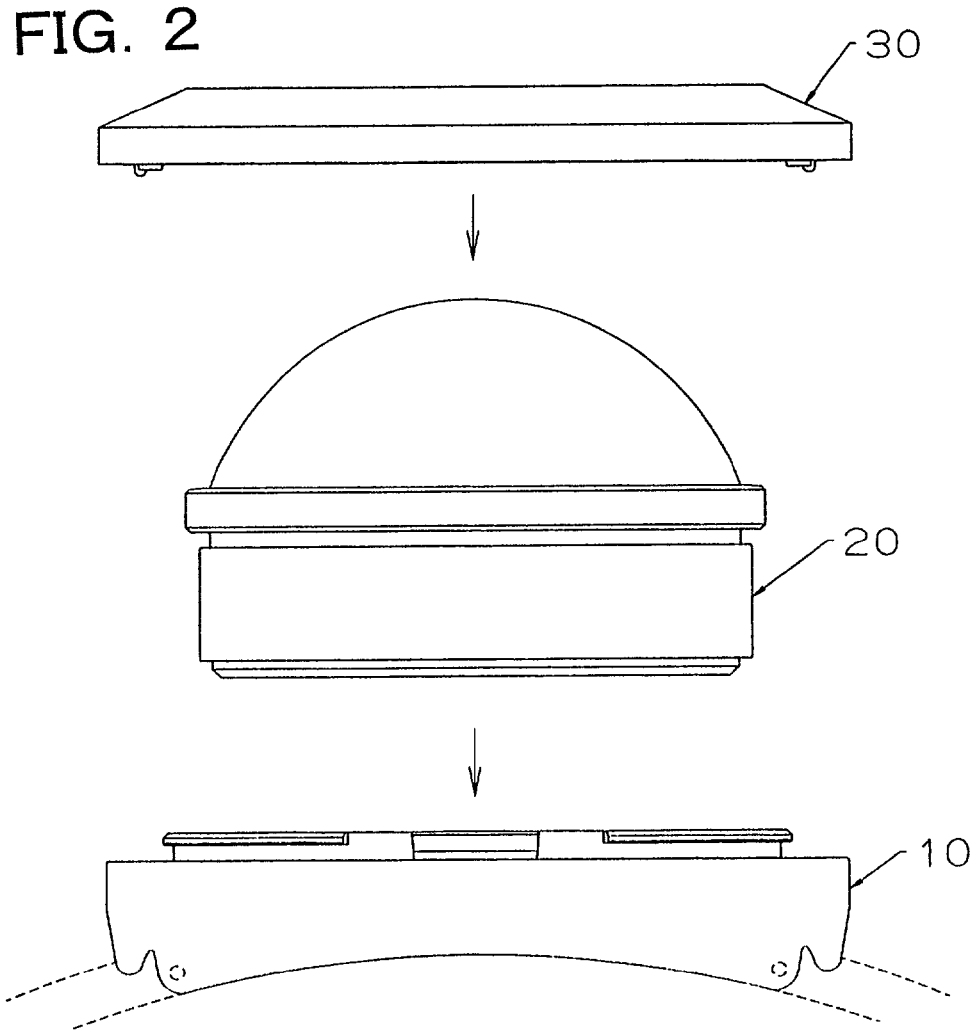
FIG. 2 is a disassembled side view showing an assembled structure of the wrist watch according to the embodiment of the invention.

FIG. 1 is a side of view of a wrist watch according to an embodiment of the invention. FIG. 2 is a disassembled side view showing an assembled structure of the wrist watch according to the embodiment of the invention. As shown by FIG. 1 and FIG. 2, the wrist watch 100 is constituted by an outer case body 10 attached with a strap shown by broken lines, an inner case body 20 attached to the outer case body 10 and a bezel 30 fixing the inner case body 20 to the outer case body 10 and subjected to a design and is of a structure assembled by fitting the inner case body 20 to the outer case body 10 and screwing the bezel 30 to the outer case body 10 such that the inner case body 20 is fixed to the outer case body 10. An explanation will successively be given of the outer case body 10, the inner case body 20 and the bezel 30 constituting the wrist watch 100.

Figure 3A:
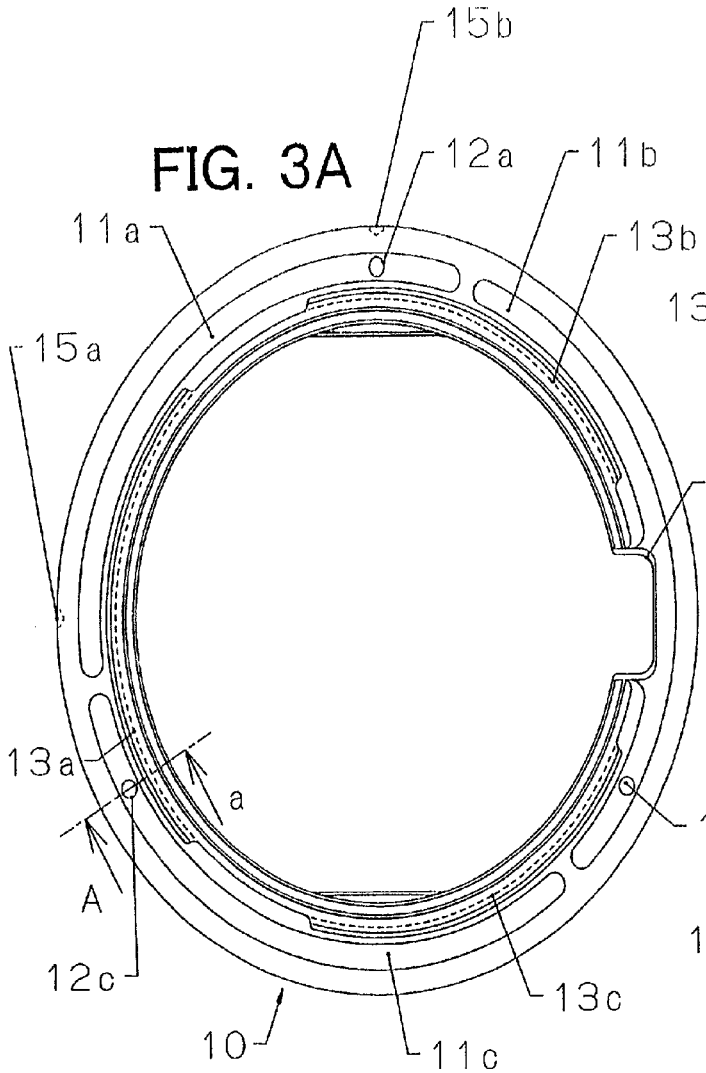
Figure 3B:
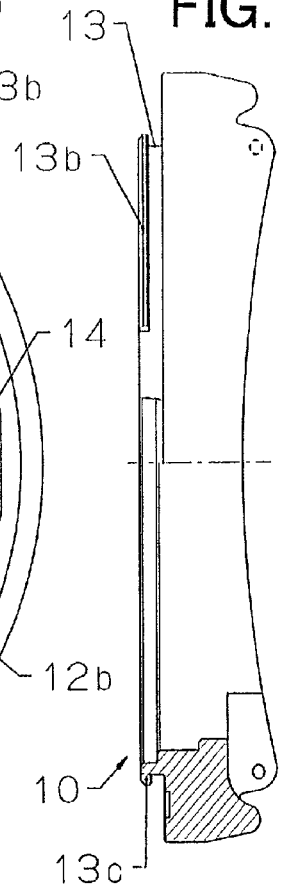
Figure 3B:
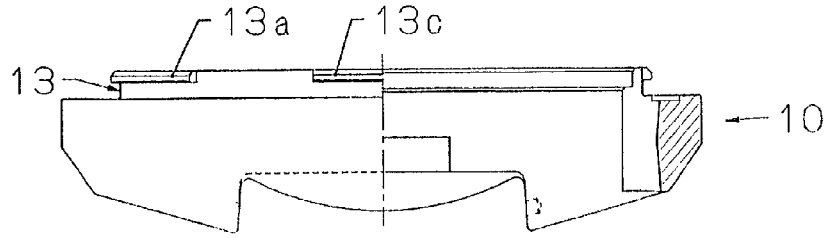
Figure 4:
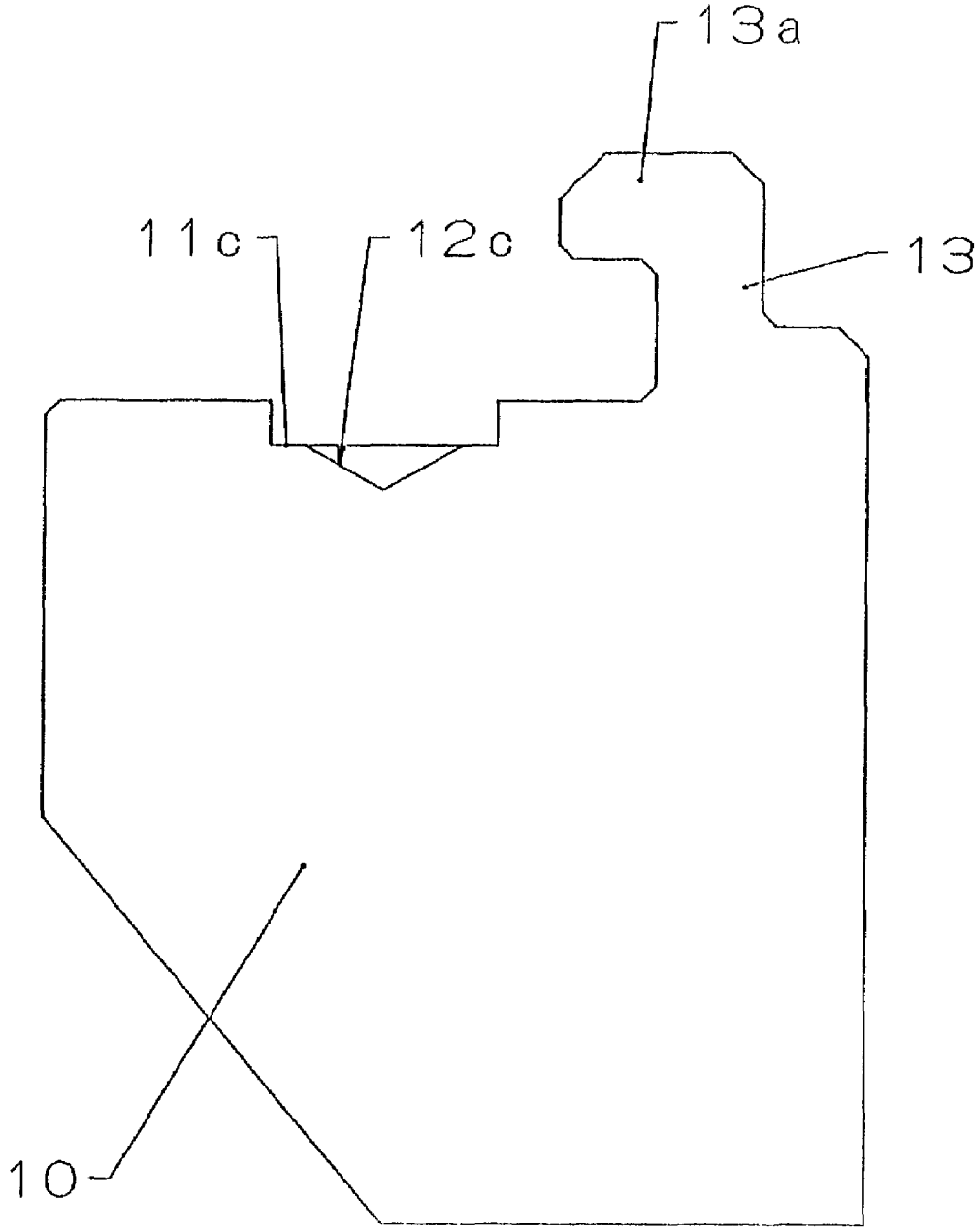
FIG. 4 is a sectional view taken along a line A-a shown in FIG. 3.

FIGS. 3 are explanatory views of the outer case body constituting the wrist watch according to the embodiment of the invention. FIG. 4 is a sectional view taken along a line A-a shown in FIG. 3. Further, FIG. 3A shows a top plane view, FIG. 3B shows a partially cut side view and FIG. 3C shows a partially cut side view. As shown by FIG. 3, the outer case body 10 is formed in a doughnut shape and provided with grooves 11*a*, 11*b* and 11*c* in a fan-like shape on a top side (watch surface side) at intervals to divide a circumference equally into three portions.

Further, as shown in FIG. 4 (FIGS. 3), the groove 11*c* is provided with a click hole 12*c* having a section in a shape of a wedge. The top side (watch surface side) of the outer case body 10 is projected with a fitting portion 13 in a shape of a circular cylinder formed with a projected edge portion 13*a*. Similarly, as shown by FIGS. 3, the grooves 11*a* and 11*b* are also provided with click holes 12*a* and 12*b*. Further, the top side (watch surface side) of the outer case body 10 is projected with the fitting portion 13 in the shape of the circular cylinder formed with projected edge portions 13*a* and 13*b*. Further, an inner wall of a hole portion of the outer case body 10 is provided with a notched portion (hereinafter, abbreviated as 'notch portion') 14. Further, a peripheral edge of the outer case body 10 is provided with positioning holes 15*a* and 15*b*. The positioning hole 15*a* is a positioning hole in detaching and fitting the bezel 30. The positioning hole 15*b* constitutes a lock position of the bezel 30.

Figure 5:
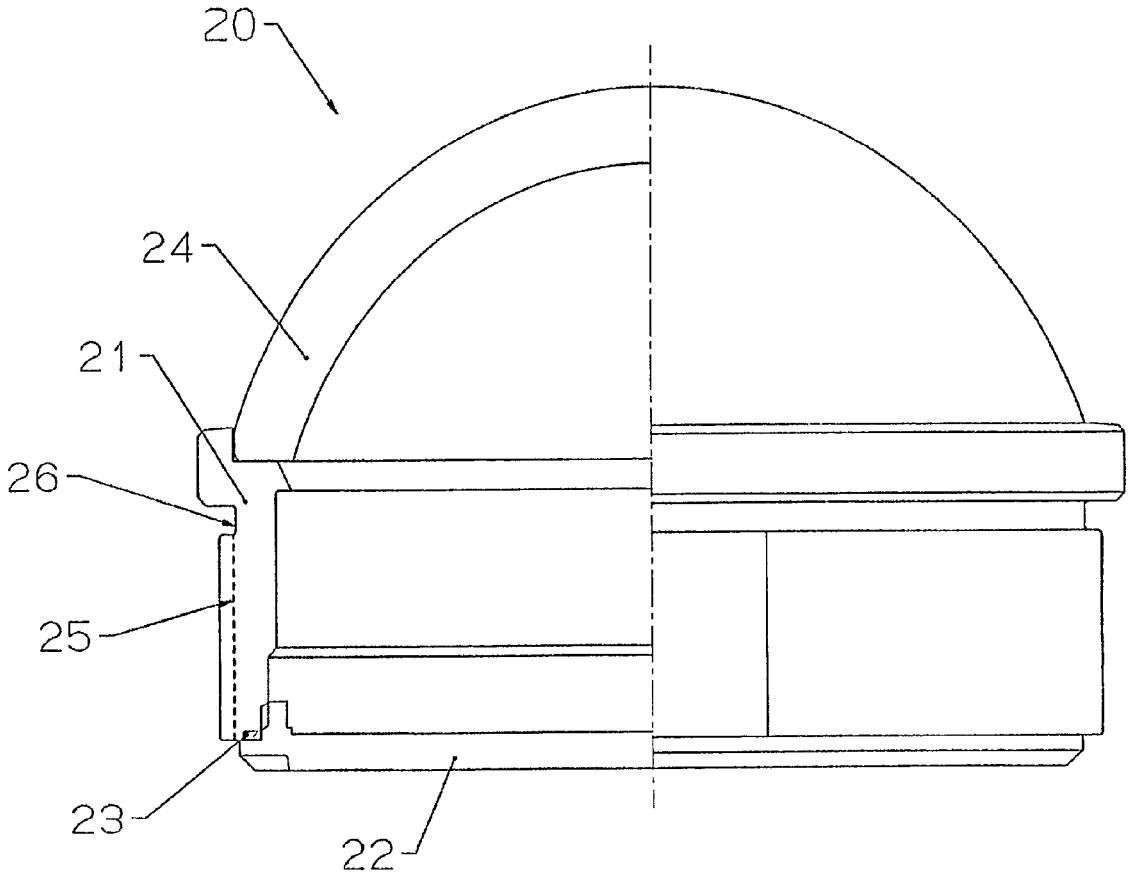
FIG. 5 is a partially cut side view of an inner case body constituting the wrist watch according to the embodiment of the invention.

FIG. 5 is a partially cut side view of the inner case body constituting the wrist watch according to the embodiment of the invention. The inner case body 20 includes a movement of an analog watch or a module of a digital watch, not illustrated, in a hermetically closed state and is provided with an inner case body main body 21 in a shape of a circular cylinder, a case back 22 attached to a bottom end side (back side of watch) of the inner case body main body 21, a case back packing 23 for ensuring water tightness between the case back 22 and the inner case back main body 21, a glass member 24 in a semispherical shape attached to a top end side (watch top side) of the inner case body main body 21, a positioning projection 25 provided at a peripheral edge of the inner case body main body 21 and a case body packing biting groove 26.

Further, although in this case, there is shown a case in which connection between the glass member 24 and the inner case body main body 21 is carried out by adhesion, the connection is not limited thereto but, for example, the connection may be carried out by plastic bonding for fixing the glass member 24 to the inner case body main body 21 by sandwiching a packing of plastic therebetween or welding. Further, although in this case connection between the case back 22 and the inner case back main body 21 is carried out by a screw fit structure via the case back packing 23, the connection is not limited thereto but, for example, the connection may be carried out by a structure of crimping or fastening by small screws.

Figure 6A:
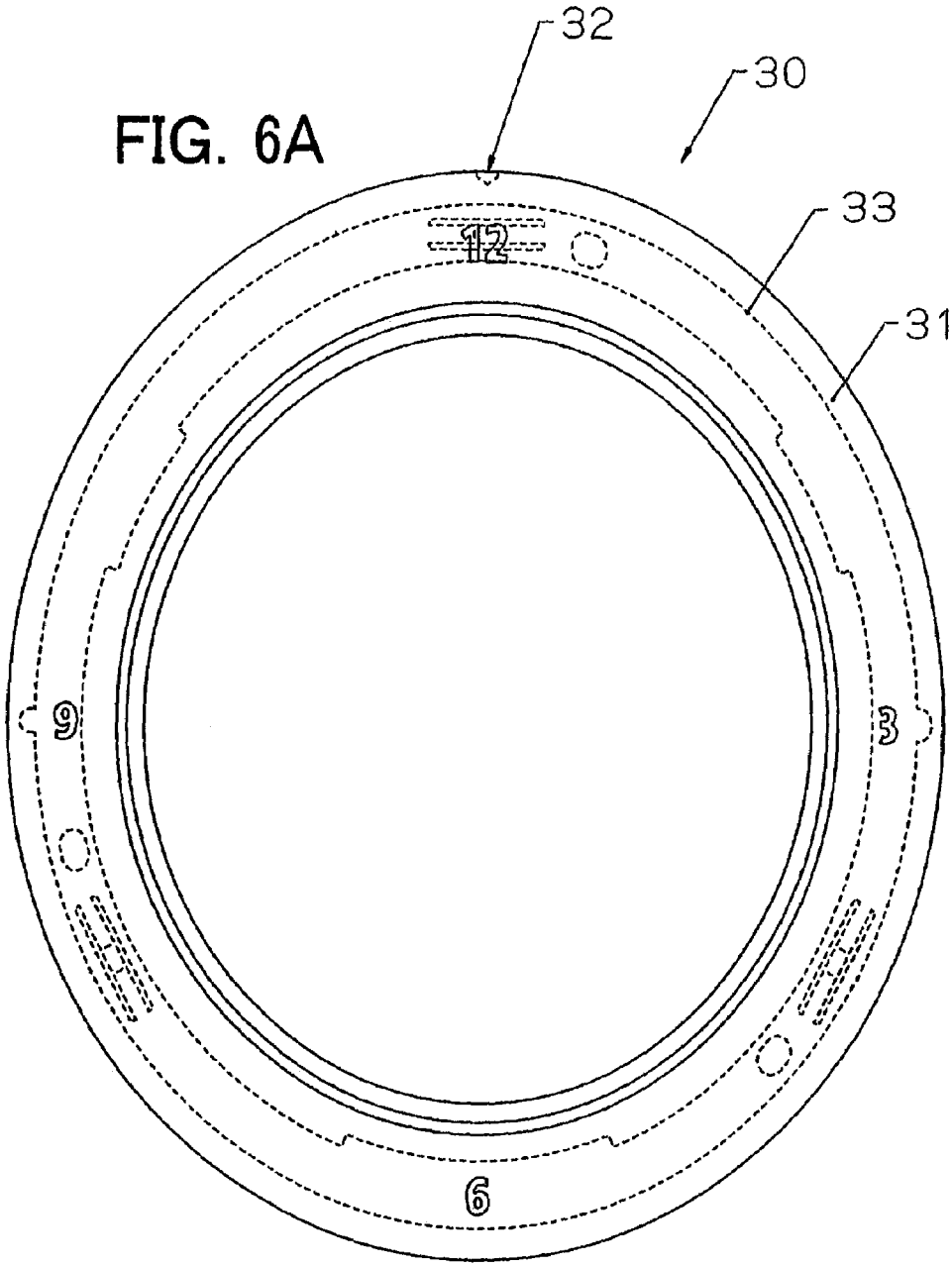
FIGS. 6A and 6B explanatory views of a bezel constituting the wrist watch according to the embodiment of the invention.
Figure 6B:
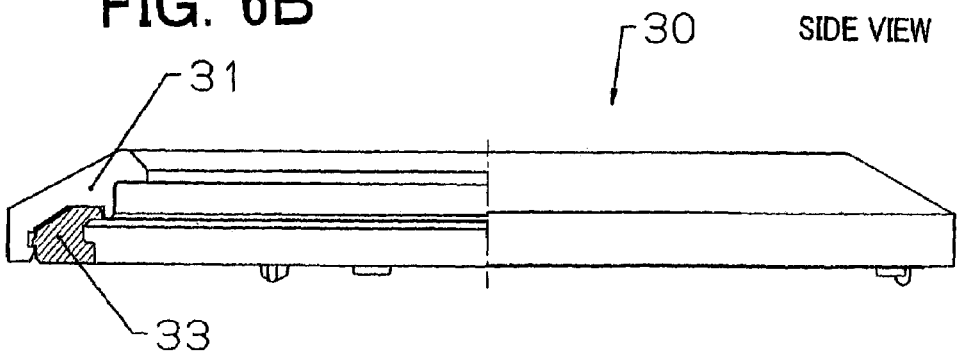

FIGS. 6A and 6B are explanatory front and side views of the bezel constituting the wrist watch according to the embodiment of the invention. The bezel 30 is provided with a decorative bezel main body 31 formed in a doughnut shape and decorated on a top side (watch top side) thereof, a mark hole 32 provided at an outer periphery of the decorative bezel main body 31 and a bayonet part 33 in a doughnut shape attached along an inner wall on a rear face side of the decorative bezel main body 31. Hereinafter, further, an explanation will be given of the bayonet part 33.

Figure 8:
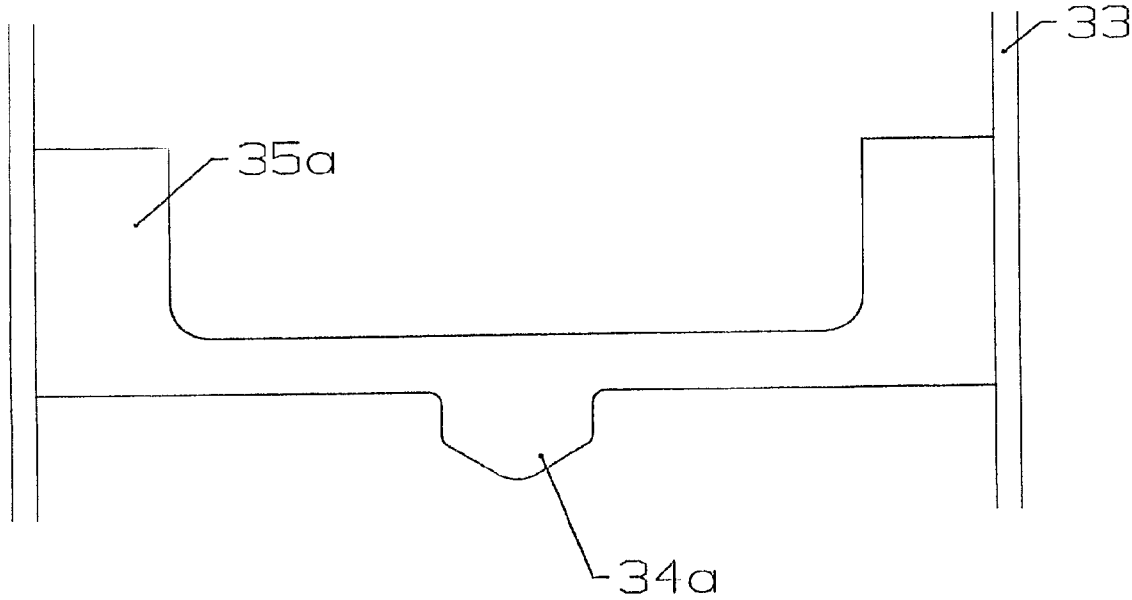
FIG. 8 is a sectional view taken along a line B-b shown in FIGS. 7.
Figures 9A, 9B:
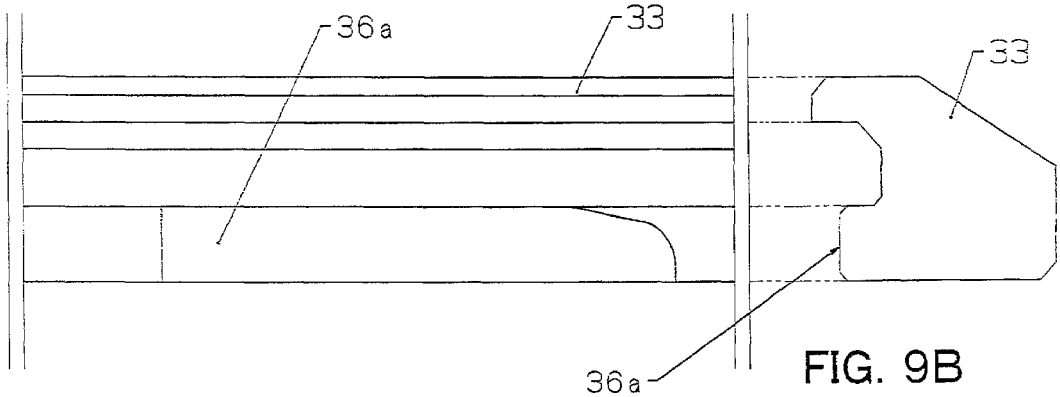
FIGS. 9A and 9B illustrate sectional views taken along a line C-c and a view viewing in an arrow mark D direction shown in FIGS. 7.

FIGS. 7 are explanatory views of the bayonet part 33 of the outer case body constituting the wrist watch according to the embodiment of the invention. FIG. 8 is a sectional view taken along a line B-b shown in FIGS. 7. FIGS. 9 illustrate sectional views taken along C-c and a view viewing in an arrow mark D direction shown in FIGS. 7. Further, FIG. 7A shows a top plane view, FIG. 7B shows a bottom plane view and FIG. 7C shows a partially cut side view. As shown by FIG. 8. (FIGS. 7), the bayonet part 33 is integrally formed with a spring member 35*a* provided with a spring projected portion 34*a* directed to a bottom plane side (watch bottom side) thereof. Similarly, as shown by FIGS. 7, the bayonet part 33 is integrally formed with spring members 35*b* and 35*c* provided with spring projected portions 34*b* and 34*c* directed to bottom plane sides (watch bottoms sides) thereof.

Further, as shown by FIG. 9 (FIGS. 7), the bayonet part 33 is integrally formed with a bayonet portion 36*a* projected to an inner wall face side thereof. When the bezel 30 is fitted to the outer case body 10 and detached therefrom, the bayonet portion 36*a* is disposed between the projected edge portions 13*c* and 13*a* of the outer case body 10, and in locking, the bayonet portion 36*a* is caught by the projected edge portion 13*a* to thereby operate such that the bezel 30 is prevented from being detached from the outer case body 10. Similarly, as shown by FIGS. 7, the bayonet part 33 is integrally formed with bayonet portions 36*b* and 36*c* projected to inner wall face sides thereof. When the bezel 30 is fitted to the outer case body 10 and detached therefrom the bayonet portions 36*b* and 36*c* are disposed respectively between the projected edge portions 13*a* and 13*b* and between the projected edge portions 13*b* and 13*c* of the outer case body 10, and in locking, the bayonet portions 36*b* and 36*c* are caught respectively by the projected edge portions 13*b* and 13*c* to thereby operate such that the bezel 30 is prevented from being detached from the outer case body 10.

Further, as shown by FIGS. 7, the bayonet part 33 is integrally formed with stoppers 37*a*, 37*b* and 37*c* directed to bottom plane sides (watch bottom sides) thereof. The stoppers 37*a*, 37*b* and 37*c* are respectively fitted to the click holes 12*a*, 12*b* and 12*c* of the outer case back 10. Further, although as a material of the bayonet part 33, POM (polyoxymethylene) is preferable in view of elasticity and durability, ABS (acrynitrile-butadiene-styrene resin) or PC (polycarbonate) may be used therefor.

Next, an explanation will be given of an assembly procedure when the watch is assembled such that the inner case body 20 is fitted to the outer case body 10 and the inner case body 20 is fixed to the outer case body 10 by the bezel 30 as shown by FIG. 2. First, the bezel 30 is made to overlap the outer case body 10 such that the bayonet portions 36*a*, 36*b* and 36*c* (refer to FIGS. 7), are fitted respectively between the projected edge portions 13*a*, 13*b* and 13*c* (refer to FIGS. 3). Next, in the case of viewing from the top plane side shown in FIG. 3A, when the bezel 30 is rotated in the clockwise direction, the bayonet portions 36*a*, 36*b* and 36*c* (refer to FIGS. 7) enter lower sides of the projected edge portions 13*a*, 13*b* and 13*c* (refer to FIGS. 3).

Simultaneously therewith, the spring projected portion 34*c* (refer to FIGS. 7) is slidingly moved above the groove 11*c*. At this occasion, the spring member 35*c* (refer to FIGS. 7) is pressed by the groove 11*c* and is brought into a state of being urged to the top side (watch top side). Further, when the bezel 30 is rotated further in the clockwise direction, the spring projected portion 34*c* is fitted to and locked by the click hole 12*c* by elastic force. In this way, by fitting the spring projected portion 34*c* to the click hole 12*c* by the elastic force, a user is provided with click feeling and can recognize that the bezel 30 is attached to a predetermined position.

Figure 10:
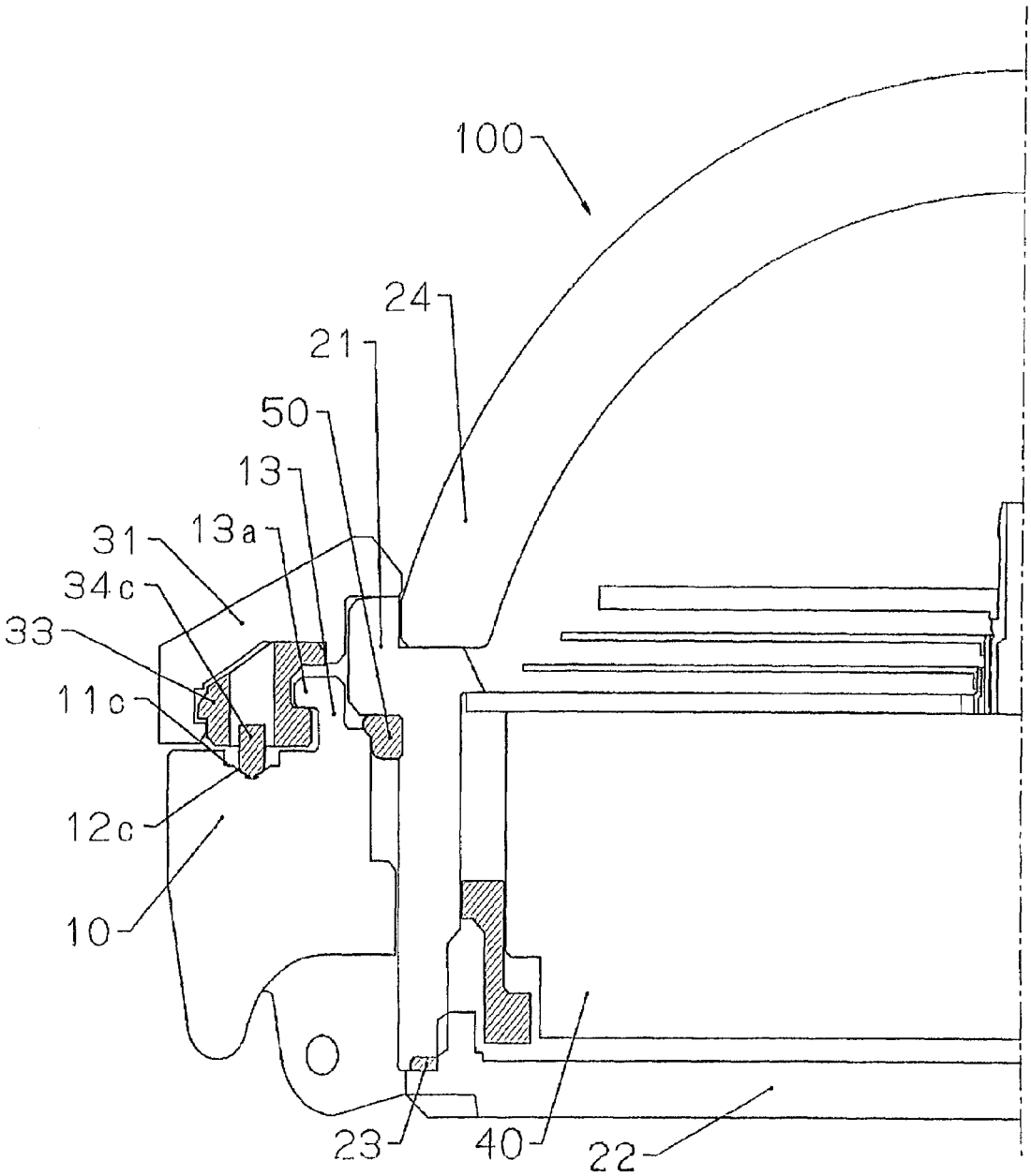
FIG. 10 is an assembled sectional view showing an assemble structure of the wrist watch according to the embodiment of the invention.

Next, an explanation will be given of the structure of a wrist watch 100 when assembled as described above. FIG. 10 is a assembled sectional view showing as assembled structure of the wrist watch according to the embodiment of the invention. As shown by FIG. 10, the wrist watch 100 is constituted by the structure in which a case body packing 50 is arranged between the main body of the inner case body 21 including a module 40 including an electronic circuit realizing watch function and the outer case body 10 and the wrist watch 100 is locked in a state in which an upper end face of a peripheral edge of the inner case body main body 21 is pressed by an inner wall face of the decorative bezel main body 31 and the spring projected portion 34*c* is fitted to the click hole 12*c*. Further, the glass member 24 is projected from the hole portion of the bezel 30, further, the case back 22 is disposed on the bottom face side of the outer case body 10.

Further, although according to the embodiment, an explanation has been given of the bezel attaching structure for locking the bezel 30 to the outer case body 10 by fitting the spring projected portion 34*c* to the click hole 12*c*, an explanation will be given of other examples 1 through 4 as follows. Further, there may be constituted any structure so far as the structure is provided with similar operation other than the above-described bezel attaching structure and the other examples 1 through 4, mentioned later.

Figure 11:
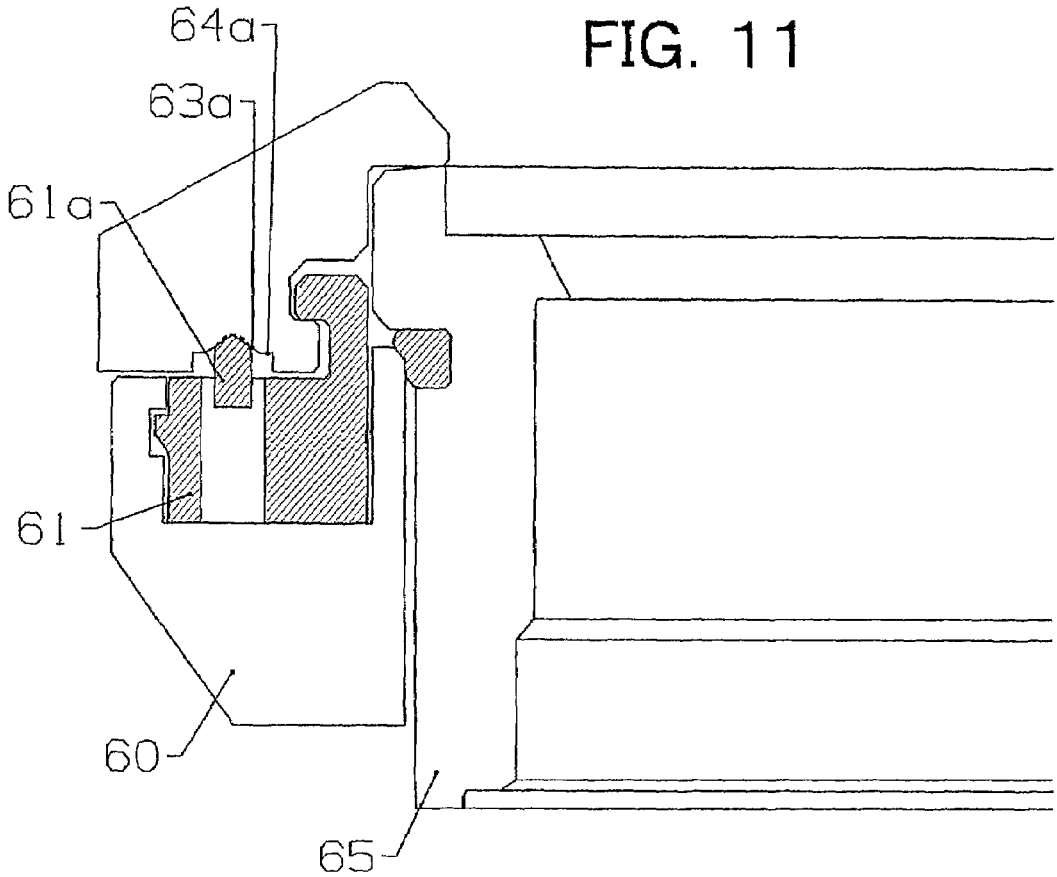
FIG. 11 is a sectional view showing other example 1 of a bezel attaching structure of a wrist watch according to an embodiment of the invention.

FIG. 11 is a sectional view showing other example 1 of a bezel attaching structure of a wrist watch according to an embodiment of the invention. The wrist watch of other example 1 is constituted by a structure in which a bayonet part 61 is attached to a side of an outer case body 60. That is, there is constructed a structure in which the bayonet part 61 is integrally formed with a spring projected portion 61*a* in correspondence with the spring projected portion 34*a*, further, a side of a bezel 62 is formed with a groove 63*a* in correspondence with the groove 11*a* and provided with a click hole 64*a* in correspondence with the click hole 12*a*. Further, an inner case body 65 is constituted to be similar to the inner case back 20. However, a glass member and a case back are omitted in the drawing.

Figure 12:
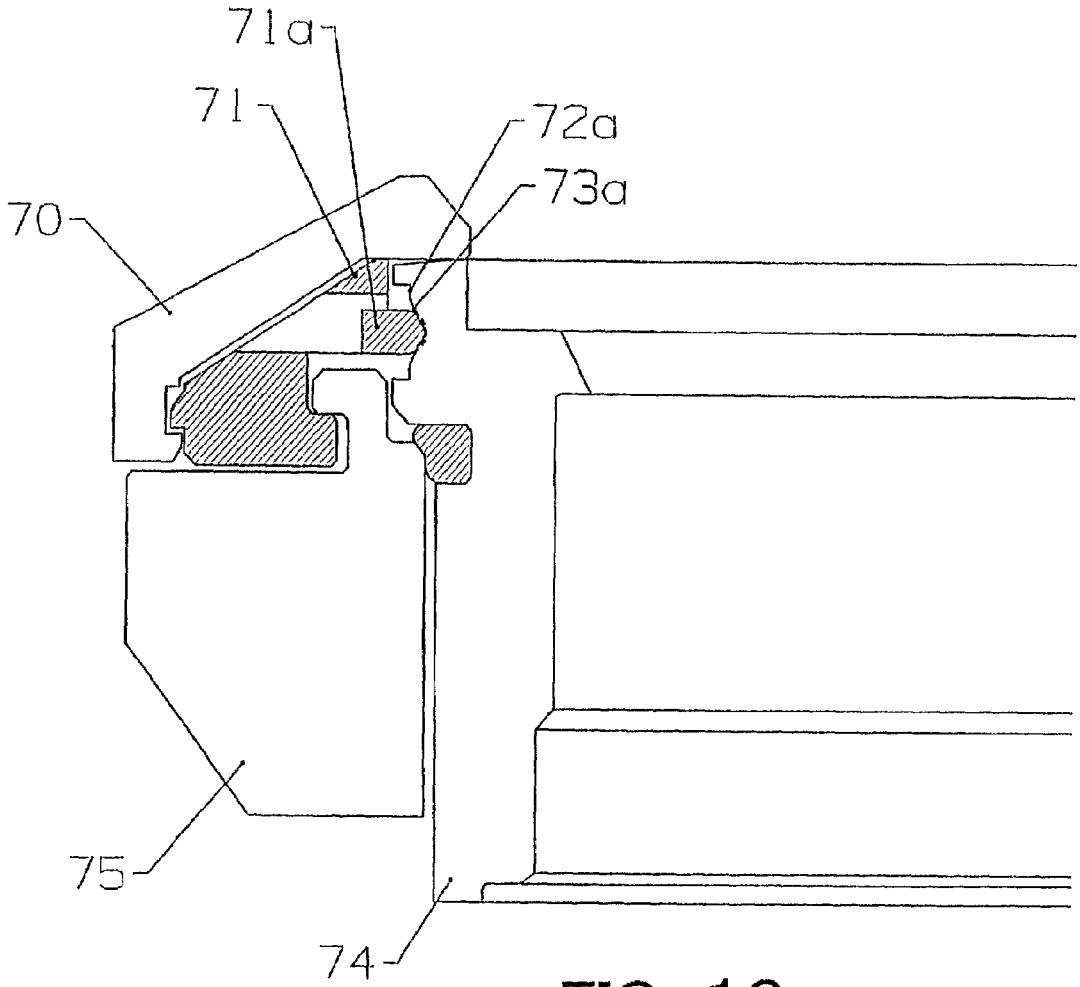
FIG. 12 is a sectional view showing other example 2 of a bezel attaching structure of a wrist watch according to an embodiment of the invention.

FIG. 12 is a sectional view showing other example 2 of a bezel attaching structure of a wrist watch according to an embodiment of the invention. The wrist watch of other example 2 is constituted by a structure in which a bayonet part 71 is attached to a side of a bezel 70 and a groove 72*a* and a click hole 73*a* are provided to an inner case body 74. That is, there is constituted a structure in which the bayonet part 71 is integrally formed with a spring projected portion 71*a* in correspondence with the spring projected portion 34*a*, further, a peripheral edge of an inner case body 74 is formed with the groove 72*a* in correspondence with the groove 11*a* and is provided with the click hole 73*a* in correspondence with the click hole 12*a*. Further, an outer case body 75 differs from the above-described in that there are not provided the inner case body 10 and the click hole. Further, in the drawing a glass member and a case back of the inner case body 74 are omitted.

Figure 13:
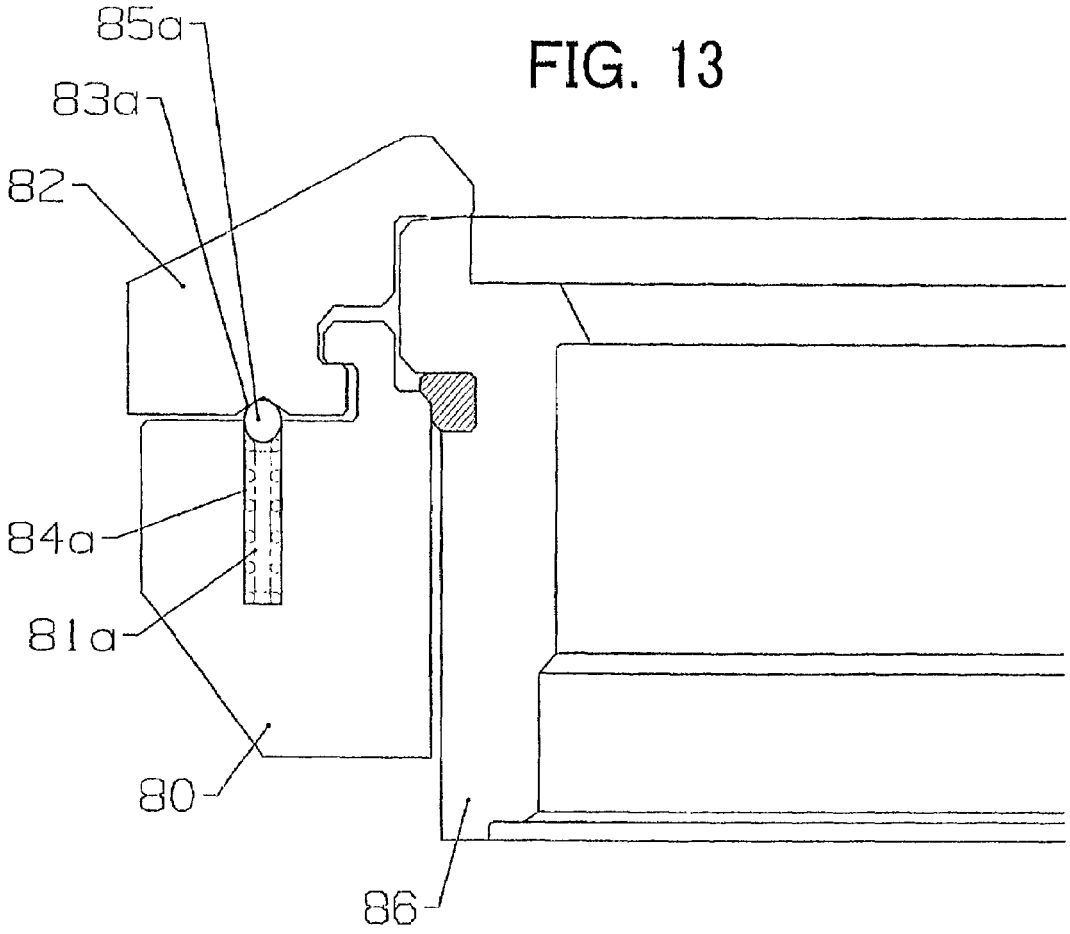
FIG. 13 is a sectional view showing other example 3 of a bezel attaching structure of a wrist watch according to an embodiment of the invention.

FIG. 13 is a sectional view showing other example 3 of a bezel attaching structure of a wrist watch according to an embodiment of the invention. The wrist watch of other example 3 is constituted by a structure in which a helical spring member 81*a* is attached to a side of an outer case body 80 and the wrist watch is locked by a click hole 83*a* provided on a side of a bezel 82. Further, the helical spring member 81*a* is inserted into a hole 84*a* provided in the outer case body 80 and a projected front end thereof is attached with a spherical member 85*a*. Further, in the drawing, a glass member and a case back of an inner case body 86 are omitted.

Figure 14:
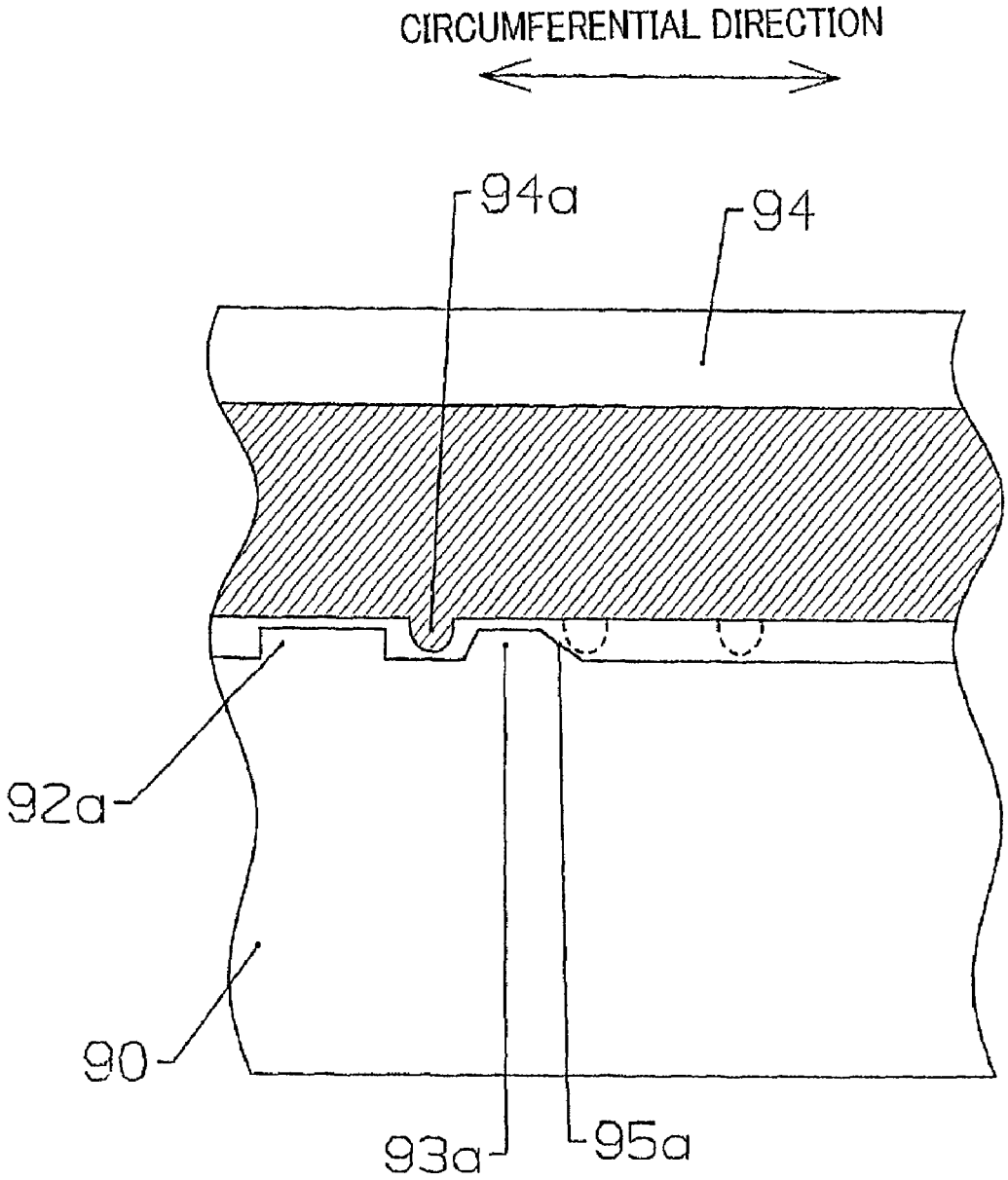
FIG. 14 is a sectional view showing other example 4 of a bezel attaching structure of a wrist watch according to an embodiment of the invention.

FIG. 14 is a sectional view showing other example 4 of a bezel attaching structure of a wrist watch according to an embodiment of the invention. The wrist watch of other example 4 is constituted by a structure in which in place of the click hole 12*c*, stopper projections 92*a* and 93*a* are provided at an outer case body 90 and a spring projected portion 94*a* of a bayonet portion 94 attached to a bezel 94, is dammed between the stopper projections 92*a* and 93*a*. Further, the stopper projection 93*a* is formed with a tapper face 95*a* such that when the bezel 94 is attached to the outer case body 90, the bezel 94 is easy to rotate in a direction of rotating thereof.

Further, although according to the above-described embodiment, an explanation has been of a case of providing the grooves 11*a*, 11*b* and 11*c* at the outer case body 10, it is not necessarily needed to provide the grooves 11*a*, 11*b* and 11*c*. Further, although an explanation has been given of a case of providing the three grooves 11*a*, 11*b* and 11*c*, a number of the grooves is not limited there to but may be any number. Similarly, numbers of the click holes 12*a*, 12*b* and 12*c* and the spring projected portions 35*a*, 35*b* and 35*c* are not limited thereto but may be any numbers. Further, although according to embodiment, the shape of the glass member 24 of the inner case body 20 is made the semi-spherical shape, the shape is not limited thereto but may be a shape of a flat plate.

Further, materials of the outer case body 10, the inner case body 20 (except the glass member) and the decorative bezel main body 31 may be either of metal and resin. Further, although the bezel attaching structure of the wrist watch according to embodiment is a structure in which the bezel 30 is attached to the outer case body 10 and the inner case body 20, even when the bezel is directly attached to a case main body of a conventional wrist watch, a similar structure can be constituted. Further, the screw structure of fixedly attaching to screw the bezel 30 to the outer case body 10, is not limited to that of the case of the above-described embodiment but, for example, there may be constituted a structure of two streaks screw.

According to the above-described embodiment, there is constituted the structure in which the bayonet part is constituted by the elastic member and the spring projected portion formed at the bayonet part slidingly moves above the outer case body and therefore, the outer case body is difficult to be impaired, further, wear of surface treatment is reduced. Further, positioning is facilitated by the spring projected portion and the click hole. For example, the positioning is facilitated by also attaching a pattern with regard to the position such as graduations at the bezel. Therefore, design performance is promoted and operation of exchange by a user is facilitated. Further, the spring projected portion is fitted to the click hole by the elastic force and accordingly, slacking by impact is difficult to occur and chances of detachment in carrying thereof can be reduced.

Therefore, according to the embodiment, by exchanging the inner case body, the wrist watch main body (inner case body) having a different function can be attached to a bezel or a strap (outer case body) having preferred design. For example, a watch main body (inner case body) in analog specification can be used by being exchanged by a watch main body (inner case body) in digital specification. Further, since the bezel can easily be exchanged, a wrist watch having a design suited to taste of a user is easy to provide by abundantly preparing designs of bezels. Further, a user can use a wrist watch having different design or function in conformity with TPO or in accordance with mood of day and a wrist watch suited to taste of a user can easily be provided.

As has been explained, according to the bezel attaching structure of the wrist watch of the invention, the bezel can easily be exchanged and accordingly, there is achieved an effect of easily providing a wrist watch having a design suited to taste of a user by abundantly preparing designs of bezels. Further, a user can use a wrist watch having different design in conformity with TPO or in accordance with mood of day and there is achieved an effect capable of easily providing a wrist watch suited to taste of a user.

Further, according to the assembled structure of the wrist watch of the invention, there is achieved and effect capable of attaching a wrist watch main body (inner case body) having different function to a bezel or a strap (outer case body) having preferred design. For example, a watch main body (inner case body) in analog specification can be used by being exchanged by a watch main body inner case body) in digital specification.

What is claimed is:

1. A wrist watch comprising: a main body having a timepiece movement disposed therein; a bezel; a bayonet structure for removably rotatably mounting the bezel to the main body, the bayonet structure comprising a projected portion having a front end provided on one of the bezel and a face of the main body confronting the bezel, and a recess portion provided on the other one of the bezel and the confronting face of the main body and removably fitted to the front end of the projected portion; a groove formed in one of the bezel and the main body; and an elastic member for urging the bezel away from the main body and being urged into the groove; wherein the groove has one or more recesses formed therein and the elastic member has one or more projections for engaging the recesses during rotation of the bezel relative to the main body to impart a click feel to rotation of the bezel.

2. A wrist watch according to claim 1; wherein the main body comprises an inner body in which the timepiece movement is disposed and having a transparent member formed over a display of the timepiece movement; and an outer body in which the inner body is disposed; wherein the bezel fixes the inner body to the outer body by sandwiching the inner body between the outer body and the bezel.

3. A wristwatch comprising: an inner body; a timepiece movement disposed in the inner body; an outer body in which is disposed the inner body; a bezel fixing the inner body to the outer body by sandwiching the inner body between the outer body and the bezel; a bayonet structure removably rotatably mounting the bezel to the outer body, the bayonet structure comprising a plurality of first projections formed about a circumference of an upper surface of the outer body, and a plurality of second projections formed about an inner circumference of the bezel for engaging the first projections, the bezel being rotatable relative to the outer body between a first position at which the second projections are disposed between the first projections so that the bezel may be removed from the outer body and a second position at which the second projections engage the first projections to prevent removal of the bezel from the outer body; a groove formed in one of the bezel and the outer body; and an elastically deformable member provided on the other of the bezel and the outer body and urged into the groove; wherein the groove has one or more recesses, and the elastically deformable member has one or more projections for engaging the recesses during rotation of the bezel relative to the main body to impart a click feel to rotation of the bezel.

4. A wristwatch according to claim 3; wherein the bezel has a bezel main body with decorative indicia provided on a top surface, and a mark hole provided on the top surface for indicating a position of the bezel relative to the outer body; and wherein the bayonet structure is provided along an inner wall on a rear surface of the bezel main body confronting a face of the outer body.

* * * * *